US007329381B2

(12) United States Patent
Woodfield et al.

(10) Patent No.: US 7,329,381 B2
(45) **Date of Patent: *Feb. 12, 2008**

(54) METHOD FOR FABRICATING A METALLIC ARTICLE WITHOUT ANY MELTING

(75) Inventors: Andrew Philip Woodfield, Madeira, OH (US); Eric Allen Ott, Cincinnati, OH (US); Clifford Earl Shamblen, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 101 days.

This patent is subject to a terminal disclaimer.

(21) Appl. No.: 10/172,218

(22) Filed: Jun. 14, 2002

(65) Prior Publication Data

US 2003/0230170 A1 Dec. 18, 2003

(51) Int. Cl.

| | |
|---|---|
| ***B22F 3/12*** | (2006.01) |
| ***C22C 14/00*** | (2006.01) |
| ***C22C 19/03*** | (2006.01) |
| ***C22C 21/00*** | (2006.01) |
| ***C22C 23/00*** | (2006.01) |
| ***C22C 32/02*** | (2006.01) |
| ***C22C 1/04*** | (2006.01) |

(52) U.S. Cl. ..... 419/30; 419/48; 419/49

(58) Field of Classification Search ..... 419/30, 419/38, 1, 48, 49; 75/351, 370, 371, 369, 75/620; 204/10–62

See application file for complete search history.

(56) References Cited

U.S. PATENT DOCUMENTS

| | | | | |
|---|---|---|---|---|
| 2,799,570 | A * | 7/1957 | Reed et al. | 419/11 |
| 2,828,199 | A * | 3/1958 | Findlay | 75/437 |
| 2,937,979 | A | 5/1960 | Wainer | |
| 3,449,115 | A * | 6/1969 | Galmiche et al. | 75/351 |
| 3,501,287 | A | 3/1970 | Lever | |
| 3,736,132 | A | 5/1973 | Easterday et al. | |
| 3,909,247 | A | 9/1975 | Paris et al. | |
| 4,101,713 | A | 7/1978 | Hirsch | |
| 4,282,195 | A | 8/1981 | Hoekje | |
| 4,373,947 | A * | 2/1983 | Buttner et al. | 75/228 |
| 4,383,852 | A | 5/1983 | Yoshizawa | |
| 4,415,528 | A | 11/1983 | Wiech | |
| 4,512,826 | A | 4/1985 | Whang | |
| 4,519,839 | A | 5/1985 | Toyoaki et al. | |
| 4,525,206 | A * | 6/1985 | Soled et al. | 75/351 |
| 4,622,079 | A | 11/1986 | Chang et al. | |
| 4,687,632 | A * | 8/1987 | Hurd et al. | 419/45 |
| 4,731,111 | A | 3/1988 | Kopatz et al. | |
| 4,820,339 | A * | 4/1989 | Bienvenu et al. | 75/368 |
| 4,894,086 | A | 1/1990 | Huether et al. | |
| 4,906,436 | A | 3/1990 | Gigliotti, Jr. et al. | |
| 4,915,905 | A | 4/1990 | Kampe et al. | |
| 4,999,336 | A | 3/1991 | Nadkarni et al. | |
| 5,032,176 | A * | 7/1991 | Kametani et al. | 75/416 |
| 5,041,262 | A | 8/1991 | Gigliotti, Jr. | |
| 5,322,666 | A | 6/1994 | Watwe | 419/32 |
| 5,328,501 | A * | 7/1994 | McCormick et al. | 75/352 |
| 5,431,874 | A | 7/1995 | Gigliotti, Jr. | |
| 5,779,761 | A | 7/1998 | Armstrong et al. | 75/370 |
| 5,830,288 | A | 11/1998 | Gigliotti et al. | |
| 5,930,580 | A | 7/1999 | Everett | 419/2 |
| 5,958,106 | A | 9/1999 | Armstrong et al. | 75/370 |
| 6,019,812 | A | 2/2000 | Volas et al. | |
| 6,152,982 | A | 11/2000 | Froes et al. | |
| 6,251,159 | B1 | 6/2001 | Angeliu et al. | |
| 6,264,719 | B1 * | 7/2001 | Zhang et al. | 75/252 |
| 6,376,103 | B1 | 4/2002 | Sampath et al. | |
| 6,409,794 | B2 | 6/2002 | Wolmer et al. | |
| 6,485,584 | B1 | 11/2002 | Lambard et al. | |
| 6,540,811 | B2 * | 4/2003 | Inazawa et al. | 75/348 |
| 6,551,371 | B1 | 4/2003 | Furuta et al. | |
| 6,582,651 | B1 * | 6/2003 | Cochran et al. | 419/5 |
| 6,635,098 | B2 | 10/2003 | Abkowitz et al. | |
| 6,663,763 | B2 | 12/2003 | Strezov et al. | |
| 6,737,017 | B2 | 5/2004 | Woodfield et al. | |
| 6,849,229 | B2 * | 2/2005 | Ott et al. | 419/36 |
| 6,921,510 | B2 * | 7/2005 | Ott et al. | 419/10 |
| 6,926,754 | B2 * | 8/2005 | Shamblen et al. | 75/765 |
| 6,968,990 | B2 * | 11/2005 | Ott et al. | 228/203 |

(Continued)

FOREIGN PATENT DOCUMENTS

| | | |
|---|---|---|
| EP | 0 728 223 B1 | 8/1997 |

(Continued)

OTHER PUBLICATIONS

Matthew J. Donachie, Jr: "Titanium (A Technical Guide"), ASM International, USA XP 002253129, p. 47-p. 51.

(Continued)

*Primary Examiner*—Roy King
*Assistant Examiner*—Ngoclan T. Mai
(74) *Attorney, Agent, or Firm*—McNees Wallace & Nurick LLC

(57) ABSTRACT

A metallic article made of metallic constituent elements is fabricated from a mixture of nonmetallic precursor compounds of the metallic constituent elements. The mixture of nonmetallic precursor compounds is chemically reduced to produce an initial metallic material, without melting the initial metallic material. The initial metallic material is consolidated to produce a consolidated metallic article, without melting the initial metallic material and without melting the consolidated metallic article.

22 Claims, 2 Drawing Sheets

U.S. PATENT DOCUMENTS

| | | | | |
|---|---|---|---|---|
| 7,001,443 | B2 * | 2/2006 | Woodfield et al. | 75/351 |
| 7,037,463 | B2 * | 5/2006 | Woodfield et al. | 419/19 |
| 2002/0073804 | A1 | 6/2002 | Dieter | |
| 2003/0205108 | A1 | 11/2003 | Hong et al. | |

FOREIGN PATENT DOCUMENTS

| | | | |
|---|---|---|---|
| EP | 1 018 386 | A1 | 12/2000 |
| EP | 1018 386 | A1 | 12/2000 |
| EP | 1433 555 | A | 6/2004 |
| EP | 1486 575 | A | 12/2004 |
| EP | 1488 874 | A | 12/2004 |
| GB | 883 429 | A | 11/1961 |
| JP | 01 184203 | A | 10/1989 |
| WO | WO9964638 | | 12/1999 |
| WO | WO 00/76698 | A1 | 12/2000 |

OTHER PUBLICATIONS

Powder Metallurgy TI-6AI-4V-x8 Alto, Journal of Medicine, May 2004.ys: Processing, Microstructure, and Properties, S. Tamirisakandala, R.B. Bhat, V.A. Ravi and D.B. Miracle, Member Journal of the Minerals, Metals & Materials Society, May 2004.

CermeTI Discontinuously Reinforced Ti-Matrix Composites: Manufacturing, Properties, and Applications, Stanley Abkowitz, Susan M. Abkowitz, Harvey Fisher and Patricia J. Schwartz, Member Journal of the Minerals, Metals & Materials Society, May 2004.

High-Temperature Deformation Behavior of Ti-TiB in-Situ Metal-Matrix Composites, Sweety Kumari, N. Eswara Prasad, K.S. Ravi Chandran and G. Malakondaiah, Member Journal of the Minerals, Metals & Materials Society, May 2004.

The Prospects for Hybrid Fiber-Reinforced Ti-TiB-Matrix Composites, W. Hanusiak, C.F. Yolton, J. Fields, V. Hammong, and R. Grabow, W. Hanusiak, C.F. Yolton, J. Fields, V. Hammond, and R. Gravow, Member Journal of the Minerals, Metals & Materials Society, May 2004.

TiB—Reinforced TI Composites: Processing, Properties, Application Prospects, and Research Needs, K.S. Ravi Chandran, K. B.I Panda, and S.S. Sahay, Member Journal of the Minerals, Metals & Materials Society, May 2004.

Titanium-Boron Alloys and Composites: Processing, Properties, and Applications, K.S. Ravi Chandran and Daniel B. Miracle, Member Journal of the Minerals, Metals & Materials Society, May 2004.

The Pre-Alloyed Powder Metallurgy of Titanium with Boron and Carbon Additions, C.F. Yolton, Member Journal of the Minerals, Metals & Materials Society, May 2004.

The Automotive Application of Discontinuously Reinforced TiB-TI Composites, Takashi Saito, Member Journal of the Minerals, Metals & Materials Society, May 2004.

Gerdemann et al., Characterization of a Titanium Powder Produced Through a Novel Continuous Process, U.S. Department of Energy, Albany Research Center, Albany, Oregon, pp. 12-41 through 12-52, USA.

Moxson et al., Production, Characterization and Applications of Low Cost Titanium Powder Products, the Minerals, Metals & Materials Society, 1998, pp. 127-137, USA.

Baburaj et al., Production of Low Cost Titanium, The Minerals, Metals & Materials Society, 1998, pp. 89-97, USA.

Gerdemann, Steven J., Titanium Process Technologies, Advanced Materials & Processes, Jul. 2001, pp. 41-43, USA.

* cited by examiner

FIG. 1
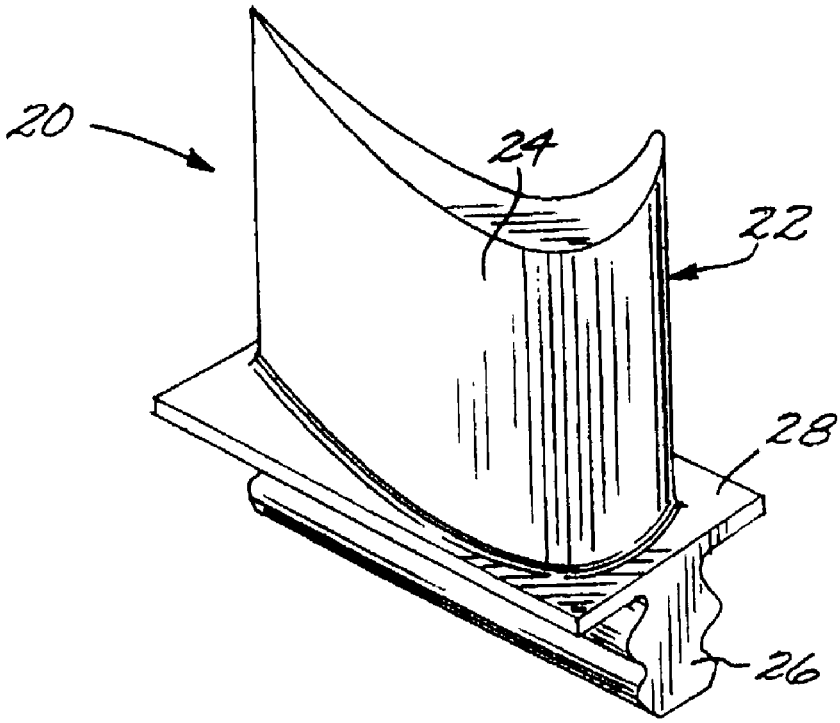
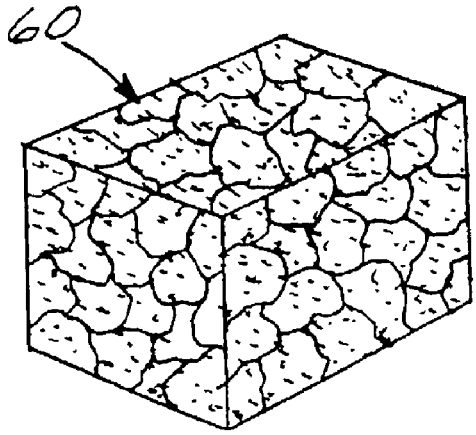
FIG. 3

METHOD FOR FABRICATING A METALLIC ARTICLE WITHOUT ANY MELTING

This invention relates to the fabrication of a metallic article using a procedure in which the metallic material is never melted.

BACKGROUND OF THE INVENTION

Metallic articles are fabricated by any of a number of techniques, as may be appropriate for the nature of the metal and the article. In one common approach, metal-containing ores are refined to produce a molten metal, which is thereafter cast. The metal is refined as necessary to remove or reduce the amounts of undesirable minor elements. The composition of the refined metal may also be modified by the addition of desirable alloying elements. These refining and alloying steps may be performed during the initial melting process or after solidification and remelting. After a metal of the desired composition is produced, it may be used in the as-cast form for some alloy compositions (i.e., cast alloys), or further worked to form the metal to the desired shape for other alloy compositions (i.e., wrought alloys). In either case, further processing such as heat treating, machining, surface coating, and the like may be employed.

As applications of the metallic articles have become more demanding and as metallurgical knowledge of the interrelations between composition, structure, processing, and performance has improved, many modifications have been incorporated into the basic fabrication processing. As each performance limitation is overcome with improved processing, further performance limitations become evident and must be addressed. In some instances, performance limitations may be readily extended, and in other instances the ability to overcome the limitations is hampered by fundamental physical laws associated with the fabrication processing and the inherent properties of the metals. Each potential modification to the processing technology and its resulting performance improvement is weighed against the cost of the processing change, to determine whether it is economically acceptable.

Incremental performance improvements resulting from processing modifications are still possible in a number of areas. However, the present inventors have recognized in the work leading to the present invention that in other instances the basic fabrication approach imposes fundamental performance limitations that cannot be overcome at any reasonable cost. They have recognized a need for a departure from the conventional thinking in fabrication technology which will overcome these fundamental limitations. The present invention fulfills this need, and further provides related advantages.

BRIEF SUMMARY OF THE INVENTION

The present invention provides a fabrication approach for metallic articles in which the metal is never melted. Prior fabrication techniques require melting the metal at some point in the processing. The melting operation, which often involves multiple melting and solidification steps, is costly and imposes some fundamental limitations on the properties of the final metallic articles. In some cases, these fundamental limitations cannot be overcome, and in other cases they may be overcome only at great expense. The origin of many of these limitations may be traced directly to the fact of melting the metal at some point in the fabrication processing and the associated solidification from that melting.

The present approach avoids these limitations entirely by not melting the metal at any point in the processing between a nonmetallic precursor form and the final metallic article.

A method for fabricating a metallic article made of metallic constituent elements comprises the steps of furnishing a mixture of nonmetallic precursor compounds of the metallic constituent elements, chemically reducing the mixture of nonmetallic precursor compounds to produce an initial metallic material, without melting the initial metallic material, and consolidating the initial metallic material to produce a consolidated metallic article, without melting the initial metallic material and without melting the consolidated metallic article. That is, the metal is never melted.

The nonmetallic precursor compounds may be solid, liquid, or gaseous. In one embodiment, the nonmetallic precursor compounds are preferably solid metallic-oxide precursor compounds. They may instead be vapor-phase reducible, chemically combined, nonmetallic compounds of the metallic constituent elements. In an application of most interest, the mixture of nonmetallic precursor compounds comprises more titanium than any other metallic element, so that the final article is a titanium-base article. The present approach is not limited to titanium-base alloys, however. Other alloys of current interest include aluminum-base alloys, iron-base alloys, nickel-base alloy, and magnesium-base alloys, but the approach is operable with any alloys for which the nonmetallic precursor compounds are available that can be reduced to the metallic state.

The mixture of the nonmetallic precursor compounds may be provided in any operable form. For example, the mixture may be furnished as a compressed mass of particles, powders, or pieces of the nonmetallic precursor compounds, which typically has larger external dimensions than a desired final metallic article. The compressed mass may be formed by pressing and sintering. In another example, the mixture of the nonmetallic precursor compounds may be more finely divided and not compressed to a specific shape. In another example, the mixture may be a mixture of vapors of the precursor compounds.

The step of chemically reducing may produce a sponge of the initial metallic material. It may instead produce particles of the initial metallic material. The preferred chemical reduction approach utilizes fused salt electrolysis or vapor phase reduction.

The step of consolidating may be performed by any operable technique. Preferred techniques are hot isostatic pressing, forging, pressing and sintering, or containered extrusion of the initial metallic material.

The consolidated metallic article may be used in the as-consolidated form. In appropriate circumstances, it may be formed to other shapes using known forming techniques such as rolling, forging, extrusion, and the like. It may also be post-processed by known techniques such as machining, surface coating, heat treating, and the like.

The present approach differs from prior approaches in that the metal is not melted on a gross scale. Melting and its associated processing such as casting are expensive and also produces microstructures that either are unavoidable or can be altered only with additional expensive processing modifications. The present approach reduces cost and avoids structures and defects associated with melting and casting, to improve the mechanical properties of the final metallic article. It also results in some cases in an improved ability to fabricate specialized shapes and forms more readily, and to inspect those articles more readily. Additional benefits are realized in relation to particular metallic alloy systems, for example the reduction of the alpha case defect and an alpha colony structure in susceptible titanium alloys.

Several types of solid-state consolidation are practiced in the art. Examples include hot isostatic pressing, and pressing plus sintering, canning and extrusion, and forging. However, in all known prior uses these solid-state processing techniques start with metallic material which has been previously melted. The present approach starts with nonmetallic precursor compounds, reduces these precursor compounds to the initial metallic material, and consolidates the initial metallic material. There is no melting of the metallic form.

The preferred form of the present approach also has the advantage of being based in a powder-like precursor. Producing a metallic powder or powder-based material such as a sponge without melting avoids a cast structure with its associated defects such as elemental segregation on a non-equilibrium microscopic and macroscopic level, a cast microstructure with a range of grain sizes and morphologies that must be homogenized in some manner for many applications, gas entrapment, and contamination. The powder-based approach produces a uniform, fine-grained, homogeneous, pore-free, gas-pore-free, and low-contamination final product.

The fine-grain, colony-free structure of the initial metallic material provides an excellent starting point for subsequent consolidation and metalworking procedures such as forging, hot isostatic pressing, rolling, and extrusion. Conventional cast starting material must be worked to modify and reduce the colony structure, and such working is not necessary with the present approach.

Another important benefit of the present approach is improved inspectability as compared with cast-and-wrought product. Large metallic articles used in fracture-critical applications are inspected multiple times during and at the conclusion of the fabrication processing. Cast-and-wrought product made of metals such as alpha-beta titanium alloys and used in critical applications such as gas turbine disks exhibit a high noise level in ultrasonic inspection due to the colony structure produced during the beta-to-alpha transition experienced when the casting or forging is cooled. The presence of the colony structure and its associated noise levels limits the ability to inspect for small defects to defects on the order of about 2/64-3/64 of an inch in size in a standard flat-bottom hole detection procedure.

The articles produced by the present approach are free of the coarse colony structure. As a result, they exhibit a significantly reduced noise level during ultrasonic inspection. Defects in the 1/64, or lower, of an inch range may therefore be detected. The reduction in size of defects that may be detected allows larger articles to be fabricated and inspected, thus permitting more economical fabrication procedures to be adopted, and/or the detection of smaller defects. For example, the limitations on the inspectability caused by the colony structure limit some articles made of alpha-beta titanium alloys to a maximum of about 10-inch diameter at intermediate stages of the processing. By reducing the noise associated with the inspection procedure, larger diameter intermediate-stage articles may be processed and inspected. Thus, for example, a 16-inch diameter intermediate-stage forging may be inspected and forged directly to the final part, rather than going through intermediate processing steps. Processing steps and costs are reduced, and there is greater confidence in the inspected quality of the final product.

The present approach is particularly advantageously applied to make titanium-base articles. The current production of titanium from its ores is an expensive, dirty, environmentally risky procedure which utilizes difficult-to-control, hazardous reactants and many processing steps. The present approach uses a single reduction step with relatively benign, liquid-phase fused salts or vapor-phase reactants processed with an alkali metal. Additionally, alpha-beta titanium alloys made using conventional processing are potentially subject to defects such as alpha case, which are avoided by the present approach. The reduction in the cost of the final product achieved by the present approach also makes the lighter-weight titanium alloys more economically competitive with otherwise much cheaper materials such as steels in cost-driven applications.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

BRIEF DESCRIPTION OF THE DRAWINGS

FIG. 1 is a perspective view of a metallic article prepared according to the present approach;

FIG. 3 is a perspective view of a spongy mass of the initial metallic material.

DETAILED DESCRIPTION OF THE INVENTION

Figure 2:
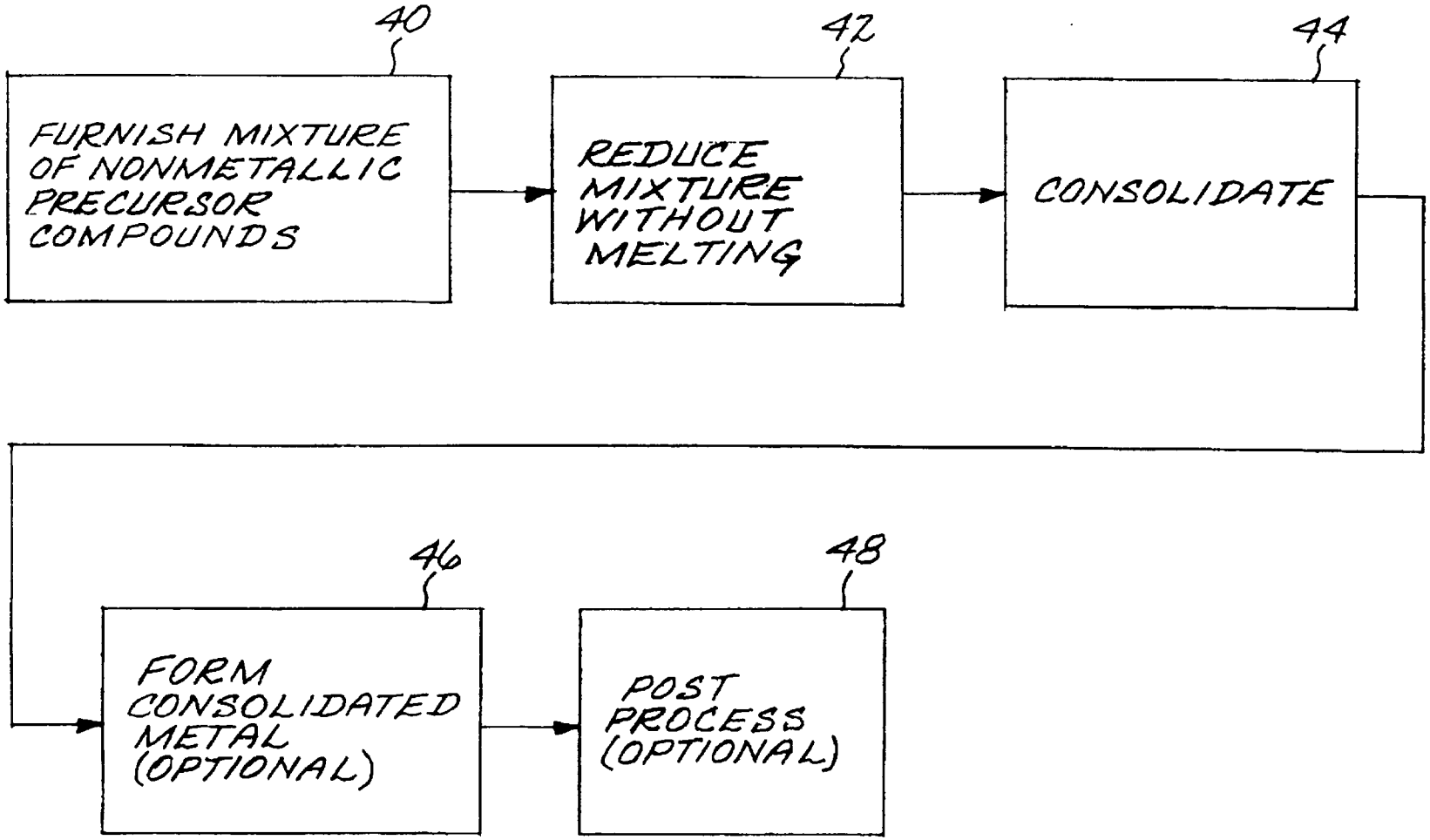
FIG. 2 is a block flow diagram of an approach for practicing the invention.

The present approach may be used to make a wide variety of metallic articles 20. An example of interest is a gas turbine compressor blade 22 illustrated in FIG. 1. The compressor blade 22 includes an airfoil 24, an attachment 26 that is used to attach the structure to a compressor disk (not shown), and a platform 28 between the airfoil 24 and the attachment 26. The compressor blade 22 is only one example of the types of articles 20 that may be fabricated by the present approach. Some other examples include other gas turbine parts such as fan blades, fan disks, compressor disks, turbine blades, turbine disks, bearings, blisks, cases, and shafts, automobile parts, biomedical articles, and structural members such as airframe parts. There is no known limitation on the types of articles that may be made by this approach.

FIG. 2 illustrates a preferred approach for practicing the invention. The metallic article 20 is fabricated by first furnishing a mixture of nonmetallic precursor compounds of the metallic constituent elements, step 40. "Nonmetallic precursor compounds" are nonmetallic compounds of the metals that eventually constitute the metallic article 20. Any operable nonmetallic precursor compounds may be used. Reducible oxides of the metals are the preferred nonmetallic precursor compounds for solid-phase reduction, but other types of nonmetallic compounds such as sulfides, carbides, halides, and nitrides are also operable. Reducible halides of the metals are the preferred nonmetallic precursor compounds in vapor-phase reduction.

The nonmetallic precursor compounds are selected to provide the necessary metals in the final metallic article, and are mixed together in the proper proportions to yield the necessary proportions of these metals in the metallic article. For example, if the final article were to have particular proportions of titanium, aluminum, and vanadium in the ratio of 90:6:4 by weight, the nonmetallic precursor compounds are preferably titanium oxide, aluminum oxide, and vanadium oxide for the solid-phase reduction process, or titanium tetrachloride, aluminum chloride, and vanadium chloride for vapor-phase reduction. Nonmetallic precursor compounds that serve as a source of more than one of the metals in the final metallic article may also be used. These precursor compounds are furnished and mixed together in the correct proportions such that the ratio of titanium: aluminum:vanadium in the mixture of precursor compounds is that required in the metallic alloy that forms the final article (90:6:4 by weight in the example). In this example, the final metallic article is a titanium-base alloy, which has more titanium by weight than any other element.

The nonmetallic precursor compounds are furnished in any operable physical form. The nonmetallic precursor compounds used in solid-phase reduction are preferably initially in a finely divided form to ensure that they are chemically reacted in the subsequent step. Such finely divided forms include, for example, powder, granules, flakes, or pellets that are readily produced and are commercially available. The preferred maximum dimension of the finely divided form is about 100 micrometers, although it is preferred that the maximum dimension be less than about 10 micrometers to ensure good homogeneity. The nonmetallic precursor compounds in this finely divided form may be processed through the remainder of the procedure described below. In a variation of this approach, the finely divided form of the nonmetallic precursor compounds may be compressed together, as for example by pressing and sintering, to produce a preform that is processed through the remainder of the procedure. In the latter case, the compressed mass of nonmetallic precursor compounds is larger in external dimensions than a desired final metallic article, as the external dimensions are reduced during the subsequent processing.

The mixture of nonmetallic precursor compounds is thereafter chemically reduced by any operable technique to produce an initial metallic material, without melting the initial metallic material, step 42. As used herein, "without melting", "no melting", and related concepts mean that the material is not macroscopically or grossly melted, so that it liquefies and loses its shape. There may be, for example, some minor amount of localized melting as low-melting-point elements melt and are diffusionally alloyed with the higher-melting-point elements that do not melt. Even in such cases, the gross shape of the material remains unchanged.

In one approach, termed solid-phase reduction because the nonmetallic precursor compounds are furnished as solids, the chemical reduction may be performed by fused salt electrolysis. Fused salt electrolysis is a known technique that is described, for example, in published patent application WO 99/64638, whose disclosure is incorporated by reference in its entirety. Briefly, in fused salt electrolysis the mixture of nonmetallic precursor compounds is immersed in an electrolysis cell in a fused salt electrolyte such as a chloride salt at a temperature below the melting temperatures of the metals that form the nonmetallic precursor compounds. The mixture of nonmetallic precursor compounds is made the cathode of the electrolysis cell, with an inert anode. The elements combined with the metals in the nonmetallic precursor compounds, such as oxygen in the preferred case of oxide nonmetallic precursor compounds, are removed from the mixture by chemical reduction (i.e., the reverse of chemical oxidation). The reaction is performed at an elevated temperature to accelerate the diffusion of the oxygen or other gas away from the cathode. The cathodic potential is controlled to ensure that the reduction of the nonmetallic precursor compounds will occur, rather than other possible chemical reactions such as the decomposition of the molten salt. The electrolyte is a salt, preferably a salt that is more stable than the equivalent salt of the metals being refined and ideally very stable to remove the oxygen or other gas to a low level. The chlorides and mixtures of chlorides of barium, calcium, cesium, lithium, strontium, and yttrium are preferred as the molten salt. The chemical reduction may be carried to completion, so that the nonmetallic precursor compounds are completely reduced. The chemical reduction may instead by partial, such that some nonmetallic precursor compounds remain.

In another approach, termed vapor-phase reduction because the nonmetallic precursor compounds are furnished as vapors or gaseous phase, the chemical reduction may be performed by reducing mixtures of halides of the base metal and the alloying elements using a liquid alkali metal or a liquid alkaline earth metal. For example, titanium tetrachloride, as a source of titanium, and the chlorides of the alloying elements (e.g., aluminum chloride as a source of aluminum) are provided as gases. A mixture of these gases in appropriate amounts is contacted to molten sodium, so that the metallic halides are reduced to the metallic form. The metallic alloy is separated from the sodium. This reduction is performed at temperatures below the melting point of the metallic alloy, so that the alloy is not melted. The approach is described more fully in U.S. Pat. Nos. 5,779,761 and 5,958,106, whose disclosures are incorporated by reference in their entireties.

The physical form of the initial metallic material at the completion of step 42 depends upon the physical form of the mixture of nonmetallic precursor compounds at the beginning of step 42. If the mixture of nonmetallic precursor compounds is free-flowing, finely divided solid particles, powders, granules, pieces, or the like, the initial metallic material is also in the same form, except that it is smaller in size and typically somewhat porous. If the mixture of nonmetallic precursor compounds is a compressed mass of the finely divided solid particles, powders, granules, pieces, or the like, then the final physical form of the initial metallic material is typically in the form of a somewhat porous metallic sponge 60, as shown in FIG. 3. The external dimensions of the metallic sponge are smaller than those of the compressed mass of the nonmetallic precursor compound due to the removal of the oxygen and/or other combined elements in the reduction step 42. If the mixture of nonmetallic precursor compounds is a vapor, then the final physical form of the metallic alloy is typically fine powder that may be further processed.

The chemical composition of the initial metallic material is determined by the types and amounts of the metals in the mixture of nonmetallic precursor compounds furnished in step 40. In a case of interest, the initial metallic material has more titanium than any other element, producing a titanium-base initial metallic material.

The initial metallic material is in a form that is not structurally useful for most applications. Accordingly, the initial metallic material is thereafter consolidated to produce a consolidated metallic article, without melting the initial metallic material and without melting the consolidated metallic article, step 44. The consolidation removes porosity from the initial metallic material, desirably increasing its relative density to or near 100 percent. Any operable type of consolidation may be used. Preferably, the consolidation 44 is performed by hot isostatic pressing the initial metallic material under appropriate conditions of temperature and pressure, but at a temperature less than the melting points of the initial metallic material and the consolidated metallic article (which melting points are typically the same or very close together). Pressing and solid-state sintering or extrusion of a canned material may also be used, particularly where the initial metallic material is in the form of a powder. The consolidation reduces the external dimensions of the mass of initial metallic material, but such reduction in dimensions is predictable with experience for particular compositions. The consolidation processing 44 may also be used to achieve further alloying of the metallic article. For example, the can used in hot isostatic pressing may not be evacuated so that there is a residual oxygen/nitrogen content. Upon heating for the hot isostatic pressing, the residual oxygen/nitrogen diffuses into and alloys with the titanium alloy.

The consolidated metallic article, such as that shown in FIG. 1, may be used in its as-consolidated form. Instead, in appropriate cases the consolidated metallic article may optionally be formed, step 46, by any operable metallic forming process, as by forging, extrusion, rolling, and the like. Some metallic compositions are amenable to such forming operations, and others are not.

The consolidated metallic article may also be optionally post-processed by any operable approach, step 48. Such post-processing steps may include, for example, heat treating, surface coating, machining, and the like. The steps 46 and 48 may be performed in the indicated order, or step 48 may be performed prior to step 46.

The metallic material is never heated above its melting point. Additionally, it may be maintained below specific temperatures that are themselves below the melting point. For example, when an alpha-beta titanium alloy is heated above the beta transus temperature, beta phase is formed. The beta phase transforms to alpha phase when the alloy is cooled below the beta transus temperature. For some applications, it is desirable that the metallic alloy not be heated to a temperature above the beta transus temperature. In this case care is taken that the alloy sponge or other metallic form is not heated above its beta transus temperature at any point during the processing. The result is a fine microstructure structure that is free of alpha-phase colonies and may be made superplastic more readily than a coarse microstructure. Subsequent manufacturing operations are simplified because of the lower flow stress of the material, so that smaller, lower-cost forging presses and other metalworking machinery may be employed, and there is less wear on the machinery.

In other cases such as some airframe components and structures, it is desirably to heat the alloy above the beta transus and into the beta phase range, so that beta phase is produced and the toughness of the final product is improved. In this case, the metallic alloy may be heated to temperatures above the beta transus temperature during the processing, but in any case not above the melting point of the alloy. When the article heated above the beta transus temperature is cooled again to temperatures below the beta transus temperature, a colony structure is formed that can inhibit ultrasonic inspection of the article. In that case, it may be desirable for the article to be fabricated and ultrasonically inspected at low temperatures, without having been heated to temperatures above the beta transus temperature, so that it is in a colony free state. After completion of the ultrasonic inspection to verify that the article is defect-free, it may then be heat treated at a temperature above the beta transus temperature and cooled. The final article is less inspectable than the article which has not been heated above the beta transus, but the absence of defects has already been established. Because of the fine particle size resulting from this processing, less work is required to reach a fine structure in the final article, leading to a lower-cost product.

The microstructural type, morphology, and scale of the article is determined by the starting materials and the processing. The grains of the articles produced by the present approach generally correspond to the morphology and size of the powder particles of the starting materials, when the solid-phase reduction technique is used. Thus, a 5-micrometer precursor particle size produces a final grain size on the order of about 5 micrometers. It is preferred for most applications that the grain size be less than about 10 micrometers, although the grain size may be as high as 100 micrometers or larger. As discussed earlier, the present approach avoids a coarse alpha-colony structure resulting from transformed coarse beta grains, which in conventional melt-based processing are produced when the melt cools into the beta region of the phase diagram. In the present approach, the metal is never melted and cooled from the melt into the beta region, so that the coarse beta grains never occur. Beta grains may be produced during subsequent processing as described above, but they are produced at lower temperatures than the melting point and are therefore much finer than are beta grains resulting from cooling from the melt in conventional practice. In conventional melt-based practice, subsequent metalworking processes are designed to break up and globularize the coarse alpha structure associated with the colony structure. Such processing is not required in the present approach because the structure as produced is fine and does not comprise alpha plates.

The present approach processes the mixture of nonmetallic precursor compounds to a finished metallic form without the metal of the finished metallic form ever being heated above its melting point. Consequently, the process avoids the costs associated with melting operations, such as controlled-atmosphere or vacuum furnace costs in the case of titanium-base alloys. The microstructures associated with melting, typically large-grained structures, casting defects, and colony structures, are not found. Without such defects, the articles may be lighter in weight. In the case of susceptible titanium-base alloys, the incidence of alpha case formation is also reduced or avoided, because of the reducing environment. Mechanical properties such as static strength and fatigue strength are improved.

The present approach processes the mixture of nonmetallic precursor compounds to a finished metallic form without the metal of the finished metallic form ever being heated above its melting point. Consequently, the process avoids the costs associated with melting operations, such as controlled-atmosphere or vacuum furnace costs in the case of titanium-base alloys. The microstructures associated with melting, typically large-grained structures and casting defects, are not found. Without such defects, the articles may be made lighter in weight because extra material introduced to compensate for the defects may be eliminated. The greater confidence in the defect-free state of the article, achieved with the better inspectability discussed above, also leads to a reduction in the extra material that must otherwise be present. In the case of susceptible titanium-base alloys, the incidence of alpha case formation is also reduced or avoided, because of the reducing environment.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A method for fabricating a metallic article made of metallic constituent elements, comprising the steps of furnishing a mixture of nonmetallic precursor compounds of the metallic constituent elements, wherein the mixture comprises more titanium than any other metallic element;

chemically reducing the mixture of nonmetallic precursor compounds to produce an initial metallic alloy material, without melting the initial metallic alloy material; separating the initial metallic alloy material from the reaction product formed during the reduction step; and consolidating the initial metallic alloy material to produce a consolidated metallic alloy article, without melting the initial metallic alloy material and without melting the consolidated metallic alloy article.

2. The method of claim 1, wherein the step of furnishing the mixture includes the step of furnishing a compressed mass of nonmetallic precursor compounds.

3. The method of claim 1, wherein the step of furnishing the mixture includes the step of furnishing a compressed mass of nonmetallic precursor compounds larger in dimensions than a desired final metallic article.

4. The method of claim 1, wherein the step of furnishing the mixture includes the step of furnishing the mixture comprising metallic-oxide precursor compounds.

5. The method of claim 1, wherein the step of chemically reducing includes the step of producing a sponge of the initial metallic alloy material.

6. The method of claim 1, wherein the step of chemically reducing includes the step of chemically reducing the mixture of nonmetallic precursor compounds by solid-phase reduction.

7. The method of claim 1, wherein the step of chemically reducing includes the step of chemically reducing the compound mixture by vapor-phase reduction.

8. The method of claim 1, wherein the step of chemically reducing includes the step of producing the initial metallic alloy material having more titanium than any other element.

9. The method of claim 8, wherein the step of consolidating includes the step of consolidating the initial metallic alloy material to produce the consolidated metallic alloy article substantially free of a colony structure.

10. The method of claim 1, wherein the step of consolidating includes the step of consolidating the initial metallic alloy material using a technique selected from the group consisting of hot isostatic pressing, forging, pressing and sintering, and containered extrusion.

11. The method of claim 1, including an additional step, after the step of consolidating, of forming the consolidated metallic alloy article.

12. A method for fabricating a metallic article made of metallic constituent elements, comprising the steps of furnishing a compressed mass of a mixture of oxides of the metallic constituent elements;

chemically reducing the oxides by fused salt electrolysis to produce a sponge of an initial metallic material, without melting the initial metallic material; and consolidating the sponge of the initial metallic material to produce a consolidated metallic article, without melting the initial metallic material and without melting the consolidated metallic article.

13. The method of claim 12, wherein the step of furnishing the mixture includes the step of furnishing a compressed mass of nonmetallic precursor compounds larger in dimensions than a desired final metallic article.

14. The method of claim 12, wherein the step of furnishing the mixture includes the step of furnishing the mixture comprising more titanium than any other metallic element.

15. The method of claim 12, wherein the step of consolidating includes the step of consolidating the initial metallic material using a technique selected from the group consisting of hot isostatic pressing, forging, pressing and sintering, and containered extrusion.

16. The method of claim 12, including an additional step, after the step of consolidating, of forming the consolidated metallic article.

17. A method for fabricating a metallic article made of metallic constituent elements, comprising the steps of furnishing a mixture of nonmetallic precursor compounds of the metallic constituent elements, wherein the mixture comprises more titanium than any other metallic element;

chemically reducing the mixture of nonmetallic precursor compounds by solid phase reduction to produce an initial metallic alloy material, without melting the initial metallic alloy material; separating the initial metallic alloy material from the reaction product formed during the reduction step; and consolidating the initial metallic alloy material to produce a consolidated metallic article, without melting the initial metallic alloy material and without melting the consolidated metallic article.

18. A method for fabricating a metallic article made of metallic constituent elements, comprising the steps of furnishing a mixture of nonmetallic precursor compounds of the metallic constituent elements, wherein the mixture comprises more titanium than any other metallic element;

chemically reducing the mixture of nonmetallic precursor compounds by liquid phase reduction to produce an initial metallic alloy material, without melting the initial metallic alloy material; and consolidating the initial metallic alloy material to produce a consolidated metallic article, without melting the initial metallic alloy material and without melting the consolidated metallic article.

19. A method for fabricating a metallic article made of metallic constituent elements, comprising the steps of furnishing a mixture of nonmetallic precursor compounds of the metallic constituent elements, wherein the mixture comprises more aluminum than any other metallic element;

chemically reducing the mixture of nonmetallic precursor compounds of the metallic constituent initial metallic alloy material, without melting the initial metallic alloy material; and consolidating the initial metallic alloy material to produce a consolidated metallic article, without melting the initial metallic alloy material and without melting the consolidated metallic article.

20. A method for fabricating a metallic article made of metallic constituent elements, comprising the steps of furnishing a mixture of nonmetallic precursor compounds of the metallic constituent elements, wherein the mixture comprises more nickel than any other metallic element;

chemically reducing the mixture of nonmetallic precursor com initial metallic alloy material, without melting the initial metallic alloy material; and consolidating the initial metallic alloy material to produce a consolidated metallic article, without melting the initial metallic alloy material and without melting the consolidated metallic article.

21. A method for fabricating a metallic article made of metallic constituent elements, comprising the steps of furnishing a mixture of nonmetallic precursor compounds of the metallic constituent elements, wherein the mixture comprises more magnesium than any other metallic element;

chemically reducing the mixture of nonmetallic precursor initial metallic alloy material, without melting the initial metallic alloy material; and consolidating the initial metallic alloy material to produce a consolidated metallic article, without melting the initial metallic alloy material and without melting the consolidated metallic article.

22. A method for fabricating a metallic article made of metallic constituent elements, comprising the steps of furnishing a mixture of nonmetallic precursor compounds of the metallic constituent elements, wherein the mixture comprises more iron than any other metallic element;

chemically reducing the mixture of nonmetallic precursor compounds by vapor phase reduction to produce an initial metallic alloy material, without melting the initial metallic alloy material; and consolidating the initial metallic alloy material to produce a consolidated metallic article, without melting the initial metallic alloy material and without melting the consolidated metallic article.

* * * * *